US006180173B1

(12) United States Patent
Sogabe et al.

(10) Patent No.: US 6,180,173 B1
(45) Date of Patent: Jan. 30, 2001

(54) RIBBON FOR SMOOTHING PRINT IMAGE AND METHOD FOR SMOOTHING PRINT IMAGE USING THE SAME

(75) Inventors: Jun Sogabe; Tetuo Hoshino, both of Osaka (JP)

(73) Assignee: Fujicopian Co., Ltd., Osaka (JP)

( * ) Notice: Under 35 U.S.C. 154(b), the term of this patent shall be extended for 0 days.

(21) Appl. No.: 09/193,282

(22) Filed: Nov. 17, 1998

(30) Foreign Application Priority Data

Nov. 17, 1997 (JP) ..... 9-315143

(51) Int. Cl.[7] ..... B41M 7/00

(52) U.S. Cl. ..... 427/370; 427/375; 428/195; 428/212; 428/409; 428/447; 428/913; 428/914

(58) Field of Search ..... 428/195, 212, 428/409, 913, 914, 323, 447; 427/355, 369, 370, 372.2, 375

(56) References Cited

U.S. PATENT DOCUMENTS 5,277,992 * 1/1994 Shinohara et al. ..... 428/704

* cited by examiner

*Primary Examiner*—Bruce Hess
(74) *Attorney, Agent, or Firm*—Fish & Neave

(57) ABSTRACT

A ribbon for smoothing a print image is disclosed which is used in a method which comprises bringing the ribbon into contact with a print image formed on a receptor by thermal transfer and heating the print image from the opposite side of the ribbon with respect to the side contacting the print image under pressure by means of a thermal head, thereby smoothing the print image. The ribbon has a kinetic friction coefficient, $\mu_A$, on the side A thereof contacting the thermal head and a kinetic friction coefficient, $\mu_B$, on the side B thereof contacting the print image, the values $\mu_A$ and $\mu_B$ satisfying the following equations:

$$\mu_B > 1.67\ \mu_A$$

$$0.10 < \mu_B < 0.25$$

8 Claims, No Drawings

RIBBON FOR SMOOTHING PRINT IMAGE AND METHOD FOR SMOOTHING PRINT IMAGE USING THE SAME

BACKGROUND OF THE INVENTION

The present invention relates to a ribbon for smoothing a print image useful for smoothing a print image formed on a receptor by thermal transfer and a method for smoothing a print image using the ribbon.

Print images formed on a receptor such as a paper sheet by thermal transfer using a thermal transfer recording medium frequently have an uneven surface and are poor in gloss, resulting in poor quality. This tendency is outstanding in color images which are obtained by superimposing yellow, magenta and cyan inks and develop a color by virtue of subtractive color mixture.

In order to improve the gloss of print images obtained by thermal transfer, a method is used wherein heat and pressure are applied to the print images through a film ribbon subjected to a release treatment.

However, when a serial type thermal transfer printer which is a small-sized thermal transfer printer adopted in a word processor, a personal computer, and the like is used and the smoothing treatment is conducted by heating the print image under pressure by means of a thermal head while feeding such a release-treated film ribbon, the ribbon slips causing traveling failure and, hence, the smoothing treatment of the print image is not favorably performed.

In view of the forgoing, an object of the present invention is to provide a ribbon for smoothing a print image which does not slip causing no traveling failure, thereby enabling favorable smoothing treatment of the print image.

Another object of the present invention is to provide a method for smoothing a print image using the ribbon.

These and other objects of the present invention will become apparent from the description hereinafter.

SUMMARY OF THE INVENTION

In accordance with a first feature of the present invention, there is provided a ribbon for smoothing a print image for use in a method which comprises bringing the ribbon into contact with a print image formed on a receptor by thermal transfer and heating the print image from the opposite side of the ribbon with respect to the side contacting the print image under pressure by means of a thermal head, thereby smoothing the print image, the ribbon having a kinetic friction coefficient, $\mu_A$, on the side A thereof contacting the thermal head and a kinetic friction coefficient, $\mu_B$, on the side B thereof contacting the print image, the values $\mu_A$ and $\mu_B$ satisfying the following equations:

$$\mu_B > 1.67\ \mu_A$$

$$0.10 < \mu_B < 0.25.$$

In accordance with a first embodiment of the first feature, the ribbon has on both sides A and B respective lubricating layers comprising the same resin as a main component, only the lubricating layer on the side B further containing particles.

In accordance with a second embodiment of the first feature, the ribbon has on the both sides A and B respective lubricating layers each comprising a silicone resin, the silicone resin of the lubricating layer on the side A containing a larger amount of a silicone chain than that of the silicone resin of the lubricating layer on the side B.

In the first embodiment of the first feature, preferably the resin of the lubricating layer on the side A and the resin of the lubricating layer on the side B each comprise a graft copolymer containing a silicone chain as a branch polymer.

In the second embodiment of the first feature, preferably the silicone resin of the lubricating layer on the side A and the silicone resin of the lubricating layer on the side B each comprise a graft copolymer containing a silicone chain as a branch polymer.

In the first embodiment of the first feature, preferably the particles have an average particle size of 0.05 to 0.5 $\mu$m.

In accordance with a second feature of the present invention, there is provided a method for smoothing a print image comprising:

bringing a ribbon for smoothing a print image into contact with a print image formed on a receptor by thermal transfer using a thermal transfer recording medium, and heating the print image from the opposite side of the ribbon with respect to the side contacting the print image under pressure by means of a thermal head, thereby smoothing the print image, wherein the ribbon has a kinetic friction coefficient, $\mu_A$, on the side A thereof contacting the thermal head and a kinetic friction coefficient, $\mu_B$, on the side B thereof contacting the print image, the values $\mu_A$ and $\mu_B$ satisfying the following equations:

$$\mu_B 1.67\ \mu_A$$

$$0.10 < \mu_B < 0.25.$$

In accordance with an embodiment of the second feature, the ribbon has on both sides A and B respective lubricating layers each comprising the same resin as a main component as the main binder resin of the back layer of the thermal transfer recording medium.

DETAILED DESCRIPTION

The present inventors have intensively investigated the reason for the traveling failure of the conventional print-image-smoothing ribbon. The present inventors found that the conventional ribbon has the same degree of slipping property on both sides thereof and fails to provide a sufficient difference between the friction force between the ribbon and the thermal head and the friction force between the ribbon and the receptor, causing the traveling failure of the ribbon. The present inventors have further conducted investigations on the basis of this finding, leading to the completion of the present invention.

That is, it has been found that when the kinetic friction coefficient, $\mu_A$, of the print-image-smoothing ribbon on the side A thereof contacting the thermal head and the kinetic friction coefficient, $\mu_B$, of the ribbon on the side B thereof contacting the print image, the values $\mu_A$ and $\mu_B$ satisfy the following equations (I) and (II):

$$\mu_B > 1.67\ \mu_A \quad \text{(I)}$$

$$0.10 <_B < 0.25 \quad \text{(II)}$$

traveling failure of the ribbon can be prevented.

When the values $\mu_A$ and $\mu_B$ satisfy the relation expressed by equation (I), the friction force of the print-image-smoothing ribbon on the side B is greater than the friction force of the ribbon on the side A, whereby preventing the ribbon from traveling failure, provided that the value $\mu_B$ satisfies equation (II). When the value $\mu_B$ is not less than 0.25, the ribbon sticks to the print image. When the value $\mu_B$ is not more than 0.10, the traveling of the ribbon is not stable.

The print-image-smoothing ribbon of the present invention has a structure wherein a lubricating layer composed of a resin as a main component is provided on one or both sides thereof of the foundation and the values $\mu_A$ and $\mu_B$ of the ribbon on both sides satisfy the relations expressed equations (I) and (II). Preferably the lubricating layer is provided on both sides of the foundation because the respective values $\mu_A$ and $\mu_B$ of both sides can be readily adjusted.

In the case of the ribbon having a structure wherein the foundation has respective lubricating layers on both sides thereof, examples of means for allowing the values $\mu_A$ and $\mu_B$ of the ribbon to satisfy equations (I) and (II) include, for instance, a means wherein different resins are used for the lubricating layer on the side A contacting the thermal head (hereinafter referred to as "lubricating layer A") and for the lubricating layer on the side B contacting the print image (hereinafter referred to as "lubricating layer B"), and a means wherein the same resin is used for both the lubricating layer A and the lubricating layer B, and a particulate substance is added to only one of the lubricating layers A and B or a particulate substance is added to both the lubricating layers A and B and the contents of the particulate substance in both layers are made different from each other.

In accordance with the first preferred embodiment of the first feature, the lubricating layers A and B are composed of the same resin as a main component and only the lubricating layer B further contains a particulate substance.

In accordance with the second preferred embodiment of the first feature, the lubricating layers A and B are each composed of a silicone resin, and the silicone resin of the lubricating layer A contains a larger amount of a silicone chain than that of the silicone resin of the lubricating layer B. The content of the silicone chain in the silicone resin is preferably from 10 to 90% by weight.

The first embodiment will be explained hereinafter.

Examples of the resins useful in the lubricating layers A and B in the first embodiment are silicone type resins such as silicone resins, silicone-modified urethane resins, and silicone-modified acrylic resins, and fluorine-containing resins. Silicone type resins are preferred and graft copolymers containing a silicone chain as a branch polymer are most preferred. Examples of trunk polymers in the graft copolymers include acrylic polymers and urethane polymers. The content of the silicone chain in the graft copolymer is preferably from 10 to 90% by weight.

Examples of the particulate substances used in the lubricating layer B include organic particulate substances such as melamine resin particles, polyethylene resin particles and acrylic resin particles, and inorganic particulate substances such as silica, calcium carbonate, magnesium carbonate, aluminum powder and diatom earth. These particulate substances may be used either alone or in combination of two or more species thereof.

The coating amount (on a dry basis, hereinafter the same) of the lubricating layer A or B is preferably from 0.05 to 1.0 $g/m^2$. When the coating amount of the lubricating layer A or B is less than the above range, it is difficult to adjust the respective kinetic friction coefficients of the lubricating layers A and B. When the coating amount of the lubricating layer A or B is more than the above range, the heat conduction is liable to be hindered.

The particles contained in the lubricating layer B are required to project from the surface thereof in order to adjust the kinetic friction coefficient. When the size of the particles is excessively large, the smoothing treatment of the print image is harmed. In consideration of these matters, the average particle size is appropriately selected from the range of 0.05 to 0.5 $\mu$m.

The content of the particulate substance in the lubricating layer B may be appropriately decided depending upon the desired kinetic friction coefficient. However, the content is preferably from about 1 to about 10% by weight so that the value $\mu_B$ satisfies the relation expressed by equation (II).

Now the second embodiment will be explained.

Useful as the silicone type resin in the second embodiment are preferably the aforesaid graft copolymers containing a silicone chain as a branch polymer. It is possible to readily adjust the respective kinetic friction coefficients of the lubricating layers A and B by changing the contents of the silicone chain as the branch polymer in the respective graft copolymers used in the lubricating layers A and B within the range of 10 to 90% by weight.

The coating amount of the lubricating layers A and B, and the like may be the same as in the first embodiment.

As the foundation useful in the present invention, there are polyester films such as polyethylene terephthalate film, polyethylene naphthalate film and polyarylate film, polycarbonate film, polyamide film, aramide film, and other various plastic films commonly used for the foundation film of thermal transfer recording media. Thin paper sheets of high density such as condenser paper can also be used. The thickness of the foundation is usually from about 1 to about 10 $\mu$m. To ensure good heat conduction, the thickness of the foundation is preferably from 1 to 6 $\mu$m.

The smoothing treatment of print images using the print-image-smoothing ribbon of the present invention is performed as follows: using a serial type thermal transfer printer wherein a cassette containing a thermal transfer recording medium is installed, a printing operation is performed to form a print image on a receptor. Then the cassette containing the thermal transfer recording medium is replaced by a cassette containing the print-image-smoothing ribbon and a printing operation is again performed, whereby the print image is heated by means of a thermal head while the print-image-smoothing ribbon is pressed against the print image on the side B with the thermal head, so that the print image is subjected to heat and pressure to be smoothed. The printing condition in the smoothing treatment may be the same as in the printing with use of the thermal transfer recording medium. However, a different condition may be adopted.

Any thermal transfer recording medium can be used to form print images subject to the smoothing treatment of the present invention. The thermal transfer recording media include, for example, those wherein one or more heat-sensitive transfer ink layers, at least one of which is a colored ink layer, are provided on a support. On the back side (the side adapted to come into slide contact with the thermal head) of the support is usually formed a back layer (sticking-preventive layer) composed of a lubricating heat-resistant resin as a main component to prevent the support from sticking to the thermal head when heated. In the present invention, it is preferable to use the same resin as the main resin of the back layer as the main resin of the lubricating layers A and B of the print-image-smoothing ribbon to maintain production efficiency and quality stability. As the aforesaid common resin, silicone type resins are preferably used. The previously mentioned graft copolymers containing a silicone chain as a branch polymer are most preferred.

The present invention will be more fully described by way of Examples and Comparative Examples thereof. It is to be understood that the present invention is not limited to these Examples, and various changes and modifications may be made in the invention without departing from the spirit and scope thereof.

EXAMPLES 1 to 2 AND COMPARATIVE EXAMPLES 1 TO 2

Three types of coating liquids I, II and III for a lubricating layer shown in Table 1 were prepared. Onto both sides of a 6 μm-thick polyethylene terephthalate film were applied coating liquids I, II and III according to the combinations shown in Table 2 and dried to form lubricating layers A and B each having a coating amount of 0.3 g/m$^2$, yielding a stock web for print-image-smoothing ribbon. The stock web was slit into print-image-smoothing ribbons each having a width of 12.7 mm.

The kinetic friction coefficients of the lubricating layers A and B of each ribbon were measured with a measuring device for kinetic friction coefficient, HEIDON TYPE-14DR, made by Shinto Kagaku Kabushiki Kaisha. The results are shown in Table 2.

The smoothing treatment of print images was performed by using each of the aforesaid print-image-smoothing ribbons.

(1) Formation of Print Image

Print images were formed on a paper receptor for thermal transfer under the following printing conditions using a serial type thermal transfer printer (Bungo JX5500 made by NEC Corporation) wherein a cassette containing a commercially available thermal transfer recording medium was installed. The thermal transfer recording medium comprised a support having a black heat-sensitive transfer layer on one side thereof and a back layer on the other side thereof. The back layer was composed of the same silicone-acryl graft copolymer as used in coating liquids I, II and III.

Printing energy: MAX. ( the value prescribed in the printer used)

Printing speed: 100 characters/second (2) Smoothing Treatment of Print Image

The cassette containing the thermal transfer recording medium in the thermal transfer printer was replaced by a cassette containing the aforesaid print-image-smoothing ribbon and a printing operation was performed under the same printing conditions as mentioned above. The traveling property of the ribbon was evaluated on the basis of the following criteria. Further the smoothness of the print images of the thus treated printed matter was evaluated on the basis of the following criteria. The results are shown in Table 2.

Traveling Property of Ribbon

○ - - - No transfer failure

× - - - Transfer failure occurs

Smoothness of Print Image

○ - - - Gloss obtained

× - - - Mottled gloss or poor in gloss

TABLE 1

| | Coating liquid | | |
|---|---|---|---|
| | I | II | III |
| Formula (parts by weight) | | | |
| Silicone-acryl graft copolymer*1 | 10 | 10 | 10 |
| Melamine resin particles (average particle size: 0.3 μm) | 0 | 0.2 | 1 |
| Methanol | 20 | 20 | 20 |
| Methyl ethyl ketone | 20 | 20 | 20 |

*1: Average molecular weight: 80 × 10$^3$, content of silicone branch chain: 40% by weight

TABLE 2

| | Lubricating layer A | | Lubricating layer B | | | |
|---|---|---|---|---|---|---|
| | Coating liquid | Kinetic friction coefficient | Coating liquid | Kinetic friction coefficient | Traveling property of ribbon | Smoothness of image |
| Com. Ex. 1 | I | 0.09 | I | 0.09 | X | ○ |
| Ex. 1 | I | 0.09 | II | 0.18 | ○ | ○ |
| Ex. 2 | I | 0.09 | III | 0.22 | ○ | ○ |
| Com. Ex. 2 | I | 0.09 | — | 0.45 | X | X |

In addition to the materials and ingredients used in the present invention, other materials and ingredients can be used in Examples as set forth in the specification to obtain substantially the same results.

When the smoothing treatment of print images formed on a receptor by use of a thermal transfer recording medium is performed using the print-image-smoothing ribbon of the present invention, the ribbon does not cause traveling failure and the print images are favorably smoothed to give print images with excellent gloss and high quality.

What is claimed is:

1. A ribbon for smoothing a print image for use in a method which comprises bringing the ribbon into contact with a print image formed on a receptor by thermal transfer and heating the print image from the opposite side of the ribbon with respect to the side contacting the print image under pressure by means of a thermal head, thereby smoothing the print image, the ribbon comprising a foundation and a lubricating layer comprising a resin provided on at least one side of the foundation, the ribbon having a kinetic friction coefficient, μA, on the side A thereof contacting the thermal head and a kinetic friction coefficient, μB, on the side B thereof contacting the print image, the values μA and μB satisfying the following equations:

$$\mu B > 1.67\ \mu A$$

$$0.10 < \mu B < 0.25.$$

2. The ribbon of claim 1, which has on both sides A and B respective lubricating layers comprising the same resin as a main component, only the lubricating layer on the side B further containing particles.

3. The ribbon of claim 2, wherein the resin of the lubricating layer on the side A and the resin of the lubricating layer on the side B each comprise a graft copolymer containing a silicone chain as a branch polymer.

4. The ribbon of claim 2, wherein the particles have an average particle size of 0.05 to 0.5 μm.

5. The ribbon of claim 1, which has on the both sides A and B respective lubricating layers each comprising a silicone resin, the silicone resin of the lubricating layer on the side A containing a larger amount of a silicone chain than that of the silicone resin of the lubricating layer on the side B.

6. The ribbon of claim 5 wherein the silicone resin of the lubricating layer on the side A and the silicone resin of the lubricating layer on the side B each comprise a graft copolymer containing a silicone chain as a branch polymer.

7. A method for smoothing a print image comprising:

bringing a ribbon for smoothing a print image into contact with a print image formed on a receptor by thermal transfer using a thermal transfer recording medium, and heating the print image from the opposite side of the ribbon with respect to the side contacting the print image under pressure by means of a thermal head, thereby smoothing the print image, wherein the ribbon comprising a foundation and a lubricating layer comprising a resin provided on at least one side of the foundation, and the ribbon has a kinetic friction coefficient, $\mu A$, on the side A thereof contacting the thermal head and a kinetic friction coefficient, $\mu B$, on the side B thereof contacting the print image, the value $\mu A$ and $\mu B$ satisfying the following equations:

$$\mu B > 1.67\ \mu A$$

$$0.10 < \mu B < 0.25.$$

8. The method of claim 7, wherein the ribbon has on both sides A and B respective lubricating layers each comprising the same resin as a main component as the main binder of the back layer of the thermal transfer recording medium.

* * * * *